US005785039A

United States Patent [19]

Kobayashi et al.

[11] Patent Number: 5,785,039

[45] Date of Patent: Jul. 28, 1998

[54] SINGLE-CRYSTALLINE DIAMOND TIP FOR DRESSER AND DRESSER EMPLOYING THE SAME

[75] Inventors: Yutaka Kobayashi; Akito Yoshida, both of Hyogo, Japan

[73] Assignee: Sumitomo Electric Industries, Ltd., Osaka, Japan

[21] Appl. No.: 739,450

[22] Filed: Oct. 29, 1996

[30] Foreign Application Priority Data

Nov. 29, 1995 [JP] Japan ..... 7-310314

[51] Int. Cl.[6] ..... B24B 53/12

[52] U.S. Cl. ..... 125/39; 451/443

[58] Field of Search ..... 125/11.01, 39; 451/443; 175/420.2, 434; 407/118, 119, 120

[56] References Cited

U.S. PATENT DOCUMENTS 5,133,332 7/1992 Tanaka et al. ..... 125/39

FOREIGN PATENT DOCUMENTS 0391418 10/1990 European Pat. Off. .
59-030668 2/1984 Japan .
03-138106 6/1991 Japan .
05-185373 7/1993 Japan .

*Primary Examiner*—Robert A. Rose
*Attorney, Agent, or Firm*—W. G. Fasse; W. F. Fasse

[57] ABSTRACT

A diamond dresser having a long life and excellent wear resistance includes at least one diamond tip. An end surface of the diamond tip perpendicular to its longitudinal direction is formed by a {211} crystal plane. Two opposite side surfaces of the diamond tip extending along the longitudinal direction are formed by {111} crystal planes. The present crystal orientation of surfaces of the tip allows each tip to be embedded in a tip holder body on a flat plane while maintaining optimum alignment with respect to the most wear-resistant direction.

7 Claims, 2 Drawing Sheets

SINGLE-CRYSTALLINE DIAMOND TIP FOR DRESSER AND DRESSER EMPLOYING THE SAME

BACKGROUND OF THE INVENTION

1. Field of the Invention

The present invention relates to a diamond dresser which is employed for adjusting a grindstone, and more particularly, it provides a single-crystalline diamond tip for a dresser and a diamond dresser which are of high performance and are economical to produce.

2. Description of the Background Art

Diamond which is excellent in hardness and wear resistance is widely employed in the industrial field of wear-resistant tools, cutting tools and the like. In particular, the so-called blade dresser which is mainly formed by embedding a single or a number of diamond tips 1 in a holding member (shank portion) 2, as shown in FIGS. 1A and 1B, is generally employed as a dresser for dressing a rotary grindstone which is formed by a base material of $Al_2O_3$, SiC or the like. Particularly in relation to such a blade dresser or a rotary dresser, it is known that the performance of the dresser is stabilized or made more consistent and a long dresser life is attained by working each single-crystalline diamond tip into a bar shape, as described in Japanese Patent Laying-Open No. 59-30668 (1984) or 5-185373 (1993).

It is known that the wear resistance of single-crystalline diamond remarkably varies with the plane orientation of the crystal. In case of using single-crystalline diamond as a tool material, selection of the plane orientation is an extremely important consideration, with regard to the tool life. Japanese Patent Laying-Open No. 59-30668 (1984) or 5-185373 (1993), for example, describe a conventional single-crystalline diamond dresser using a bar-shaped single-crystalline diamond tip having an end surface which is formed by a {110}, {100} or {111} plane for dressing a grindstone. However, a diamond dresser having a working end surface in a {110} or {100} plane orientation has disadvantageously inferior wear resistance. On the other hand, a diamond dresser having a working end surface in a {111} plane orientation has a short tool life and the tool must be frequently exchanged, because the end surface acting on a grindstone is easy to cleave and separate or break during use due to the property of the single-crystalline diamond which is easy to cleave along the {111} plane.

In relation to a single-crystalline diamond dresser, it is advantageous that its diamond tip is embedded in such an orientation that the maximum wear-resistant direction of the diamond is parallel with the dressing direction, i.e., the direction of friction with the grindstone that is being dressed, or adjusted. FIG. 2A shows the maximum wear-resistant direction, i.e., a <110> direction, of a single-crystalline diamond having an end surface formed by a (110) plane, and having one pair of opposite side surfaces formed by {111} planes and one pair of opposite side surfaces formed by {211} planes. FIG. 2B shows the maximum wear-resistant direction, i.e., a <110> direction, of a single-crystalline diamond having an end surface formed by a (100) plane and having opposite side surfaces formed by {100} planes. In general, either a method of identifying crystal planes by X-ray diffraction or the like, or a method of indexing crystal planes by the technique of a skilled operator have been employed in order to correctly find the maximum wear-resistant direction. Then, the diamond tip is embedded, considering the maximum wear-resistant direction.

As to general steps of manufacturing a bar-shaped tip for a dresser, it is the most economical tip manufacturing method to prepare a thin plate by cleaving rough diamond, and to work the same into a prismatic form by cutting with a laser beam or the like, as described in Japanese Patent Laying-Open No. 3-138106 (1991). When an end surface of the tip prepared in such a manner is formed by a {110} plane, it is necessary to position the wear-resistant direction of the end surface, i.e., the <110> direction, not to be in parallel with each side surface but to be inclined by 55° as shown in FIG. 2A, and also as described in Japanese Patent Laying-Open No. 5-185373 (1993). This comes into question particularly when preparing a multi-tip or dresser whereby it is difficult to correctly arrange all tips along the maximum wear-resistant directions for properly embedding the tips in a holding member. Thus, the working or manufacturing efficiency is deteriorated, causing an economic problem, and also causing variation or dispersion in the performance of the dresser as a product.

It is well known that diamond is the hardest substance among those present on earth. In case of applying diamond to a dresser, however, its wear resistance remarkably varies with the orientation of single-crystalline diamond. The conventional single-crystalline diamond tip, shown in FIG. 2A or 2B, has the minimum abrasion loss along substantially diagonal directions, and hence the diamond dresser must inevitably be in the mode shown in FIGS. 1A and 1B. In this case, the substantially diagonal lines of the single-crystalline tips must be parallel to the directions of the dresser being rubbed by the grindstone, i.e., the side surfaces of the dresser. In general, this type of dresser is made by inclinedly embedding the single-crystalline diamond tips in metal powder and sintering the same. The inclination must ideally be 55° in this case. However, the orientation of the single-crystalline diamond tips is difficult to fix and is easily disturbed, so that it is extremely difficult to attain the set inclination with precision. Particularly in case of employing a number of single-crystalline diamond tips, it is further difficult to manufacture a diamond dresser having stable wear resistance, due to variations in the inclination of each single-crystalline diamond tip. The present invention is adapted to solve such problems.

SUMMARY OF THE INVENTION

An object of the present invention is to provide a single-crystalline diamond tip for a dresser which allows easy determination of a wear-resistant direction and proper embedding thereof.

Another object of the present invention is to provide a single-crystalline diamond tip for a dresser which can simplify an embedding operation and improve the accuracy of the embedded position.

Still another object of the present invention is to provide a diamond dresser which is excellent in wear resistance and has a long tool life.

A further object of the present invention is to provide a diamond dresser having small dispersion of wear resistance, i.e. where there is little variation in wear resistance from one diamond tip to another.

The inventive diamond tip made of single-crystalline diamond has a bar shape, and has an end surface, perpendicular to its longitudinal direction, having a crystal orientation along a {211} plane, and has two opposite side surfaces, along the longitudinal direction having crystal orientations along {111} planes. The single-crystalline diamond employed for the tip is preferably prepared from artificially synthesized diamond containing nitrogen from 5 ppm to 300 ppm. A diamond dresser is manufactured by embedding a single or a plurality of such diamond tips in a holder so that an end surface of each tip defines a working surface for a grindstone, which serves as a workpiece and a pair of opposite sides of a polygon defining this end surface are substantially parallel to the frictional direction of the grindstone.

In order to solve the aforementioned problems, the present invention provides a single-crystalline diamond tip for a dresser which has a low cost, has high wear resistance, allows easy determination of a wear-resistant direction and embedding, and is excellent in economy. The present invention further provides a dresser by forming on a single-crystalline diamond an end surface, which is perpendicular to a longitudinal direction, and which will be a working surface for adjusting a grindstone surface by a {211} plane, while forming opposite side surfaces thereof by {111} planes. According to the present invention, the crystal plane orientation of the working surface for adjusting the grindstone surface is formed by a {211} plane, which has higher wear resistance than a {110} plane and a {100} plane, and higher chipping resistance and breaking resistance than a {111} plane due to the respective properties of the crystal planes, whereby the tool life is improved over the prior art.

In case of manufacturing a diamond tool, a {100} or {110} plane is generally employed for a working surface. This is mainly because the {100} or {110} plane can be readily ground. In other words, the {100} or {110} plane is easy to wear, and hence this plane is not preferable as a working surface of a dresser. While a {111} plane is known as a plane having the highest wear resistance, diamond is easy to cleave along this plane, leading to breakage of the tool. Thus, the {111} plane is not utilized as a tool working surface in general.

The inventors have made various studies on the aforementioned points, and discovered that a working surface of a diamond tip for dressing a grindstone which is formed by a {211} plane is excellent in wear resistance and has no cleavability. When manufacturing a general diamond tool, its working surface must be formed by grinding the same as described above, and hence the {211} plane which is hard to grind is not used as a working surface. In a dresser to which the present invention is applied, however, an end surface of each tip thereof is already worked into a flat surface by a laser beam or the like, and hence the end surface need not be ground in a manufacturing step. Further, the tip can be used to the end, with no requirement for re-grinding, even if the tip is worn during use. Thus, remarkable improvement of performance for serving as a dresser has been discovered through employment of the {211} plane, which is hard to grind and has not been employed for general tools. Such a diamond tip can be obtained by cutting a plate-type diamond member, which is prepared by cleaving single-crystalline diamond along its {111} plane, into the form of a strip. This diamond tip is manufactured through steps similar to those for the conventional diamond tip shown in FIGS. 2A or 2B. The difference between the inventive and conventional diamond tips resides in the angles used for cutting plate-shaped diamond members having {111} planes into the form of strips. The diamond tip shown in FIGS. 2A or 2B has such advantages that the cutting angle can be readily set and the product yield is high due to employment of a simple plane orientation. However, the conventional diamond tip is inferior in practical terms for application to a diamond dresser, as described above.

It has been possible to attain the present invention only by ignoring the difficulty in manufacturing of a diamond tip and regarding the handiness and performance of a diamond dresser as important. The maximum wear-resistant direction of the inventive diamond tip is parallel to the {111} plane, of the side surfaces whereby angle displacement of the tip when embedding the same can be extremely reduced and a diamond dresser having small dispersion in wear resistance can be provided.

In order to effectively carry out the present invention, accuracy of the crystal orientation is preferably as high as possible, and it is preferable that an error of the crystal orientation of the end surface is within 5° from the {211} plane in the inventive single-crystalline diamond tip for a dresser. When the end surface is formed by the {211} plane, it is possible to employ a working method utilizing cleavage as described in Japanese Patent Laying-Open No. 3-138106 (1991), for manufacturing the tip by forming a pair of opposite side surfaces thereof by {111} planes since the {111} plane is one of the plane orientations perpendicular to the {211} plane.

By using this working method, high-priced rough diamond having a small working margin can be worked into a thin plate with a high yield, and the working time for cutting the rough diamond can be remarkably shortened as compared with cutting with a laser beam or a diamond blade. The thin plate obtained in this manner has flat upper and lower surfaces which are formed by {111} planes, and a tip can be readily manufactured at a low cost by cutting the thin plate into the form of a strip with a laser beam machine or the like. While the tip typically has a rectangular or square section, the tip may have a parallelogrammic or trapezoidal section.

The maximum wear resistance is attained along the <110> direction on the {211} plane, which is the plane orientation of the end surface of the tip. Since the {211} plane forming the end surface and the {111} planes forming the side surfaces intersect with each other on ridge lines which are matched i.e. parallel with the maximum wear-resistant <110>direction, this wear-resistant direction can be readily identified to facilitate proper and consistent embedding of the tip. It is a well-known fact that the maximum wear-resistant direction on a working surface of a diamond tip which is embedded in a dresser is preferably matched with the rotational direction of a grindstone, i.e., the direction for dressing the grindstone. Therefore, it is an important factor determining the performance of the dresser tool itself that during manufacture of the dresser, a tip embedding operation is relieably performed with high accuracy, so that the dressing direction is matched with the maximum wear-resistant direction of each tip. This is particularly important in relation to a dresser having a plurality of tips. In general, a diamond tip for a dresser is embedded in a holder by a method of embedding the tip in metal powder, thereafter pressurizing the metal powder embedding the tip, and sintering/contracting the metal powder at a high temperature, so that the tip is not displaced or loosened by high stress during the operation.

When it is necessary to remarkably incline the tip with respect to the shank portion, when embedding the tip, as described in Japanese Patent Laying-Open No. 5-185373 (1993), it is not easy to arrange the tip in the metal powder while maintaining the desired correct angle throughout the operation, and it is extremely difficult to correctly hold the diamond crystal tip orientations through the pressurizing and heating steps. According to the present invention, however, the wear-resistant directions of the tips are matched or aligned with a working direction for using the dresser when the tips are simply arranged on metal powder which is brought into a flat state, whereby the alignment and embedding operations can be very easily and readily carried out with little variation. Therefore, effects of the present invention in the ease and accuracy of the embedding operation are effectively exhibited as the number of the embedded tips is increased. It is obvious that the present invention is remarkably effective in a rotary dresser having several 10 or several 100 tips embedded in its outer peripheral portion, in particular.

When each tip has a rectangular or square sectional shape, plane orientations of another pair of side surfaces, other than the opposite {111} planes, are {110} planes, and the end surface of the {211} plane intersects with the side surfaces of the {110} planes on ridge lines in the <111> direction, which has wear resistance close to that of the aforementioned <110> direction. Therefore, the dresser can also be used in this <111> direction, depending on and responsive to the shape or application of the tool. According to the inventors' knowledge obtained as a result of their studies, it has been clarified that a <111> direction on a {211} plane exhibits wear resistance which is remarkably superior to that in the maximum wear-resistant direction on a {100} or {110} plane, i.e., a <110> direction. Thus, the present invention can also provide a dresser which is usable not only in one direction but in two perpendicular directions.

The volume of the single-crystalline diamond employed in the present invention is relatively reduced with respect to the area of the working surface as compared with the so-called single-stone dresser prepared by embedding natural rough diamond in a holder in a rough state, which is widely employed in general, due to the bar shape of the tip. In order to dissipate the heat produced during dressing, it is preferable that the diamond itself has high heat conductivity. It is known that artificially synthesized single-crystalline diamond has higher heat conductivity than natural diamond, due to differences in amounts and modes of nitrogen contained in the crystals, and that a crystal having a lower nitrogen content has higher heat conductivity.

With respect to the present invention, therefore, it is preferable to use synthetic diamond having a nitrogen content of not more than 300 ppm. On the other hand, it is known that the growth rate of synthetic diamond crystal must be reduced in order to grow a crystal having a nitrogen content of less than 5 ppm, and the cost for synthetic rough diamond itself is uneconomically increased in this case. Also in a method of producing tips utilizing cleavage, which is the most economically effective means for manufacturing the inventive diamond tip, {111} cleavage planes can be readily indexed by employing synthetic diamond having a polygonal rough shape formed by flat planes, and this can be regarded as preferable as compared with the case of using natural rough diamond having curved surfaces.

As hereinabove described in detail, the present invention provides a dresser having smaller abrasion loss and a longer tool life as compared with the prior art. Further, stability in dresser manufacturing steps and economy are improved due to simplification of operations and improvement of accuracy resulting from ease of determination of the wear-resistant direction and embedding most consistently. Thus, labor saving and simplification in grinding steps are enabled by using the low-priced dresser having a long life and stable performance, which can be manufactured according to the present invention.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

An embodiment of the present invention is now described with reference to the drawings.

Figure 1A:
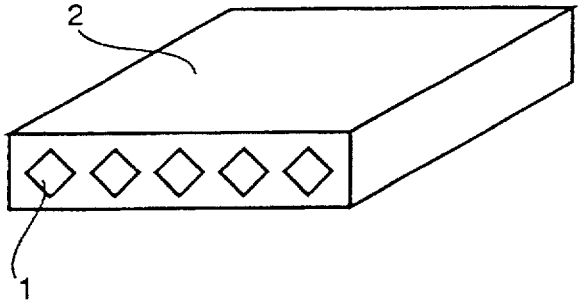
FIG. 1A PRIOR ART
FIGS. 1A and 1B are a perspective view and a plan view with internal ghost lines showing a conventional blade dresser respectively.
Figure 1B:
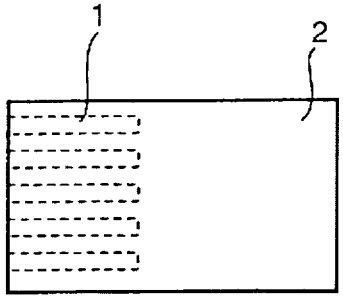
FIG. 1B PRIOR ART
Figure 2A:
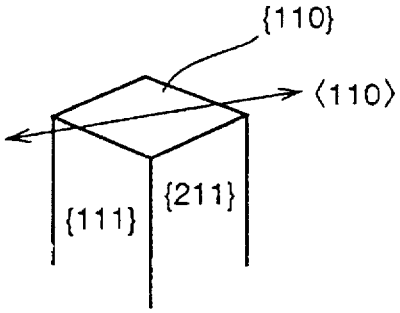
FIG. 2A PRIOR ART
FIGS. 2A and 2B are perspective views showing wear-resistant directions of conventional single-crystalline diamond tips by arrows respectively.
Figure 2B:
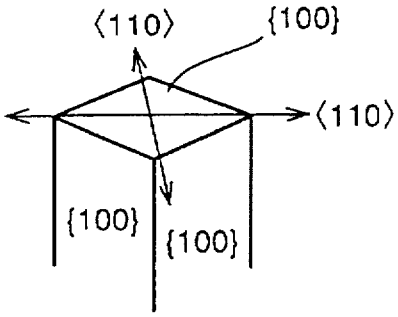
FIG. 2B PRIOR ART
Figure 3A:
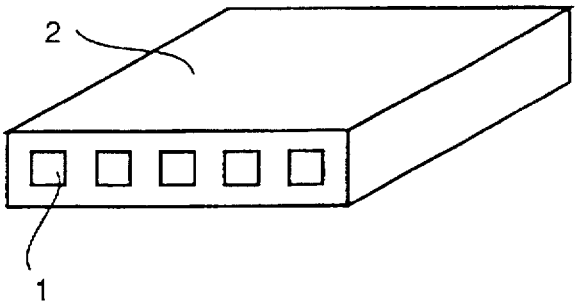
FIG. 3A is a perspective view showing a blade dresser according to the present invention.
Figure 3B:
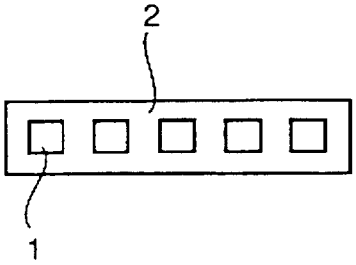
FIG. 3B is a front elevational view showing a working surface thereof.

As shown in FIGS. 3A and 3B, a blade dresser according to an embodiment of the present invention is formed by embedding a plurality of single-crystalline diamond tips 1, which have bar shapes, into a shank portion 2 so that end surfaces of the tips 1, i.e. the working or dressing surfaces, are exposed. The tips 1 are held by a sintered metal. FIGS. 4A to 4G illustrate different possible working surface arrangements of such blade dressers.

Figure 4A:
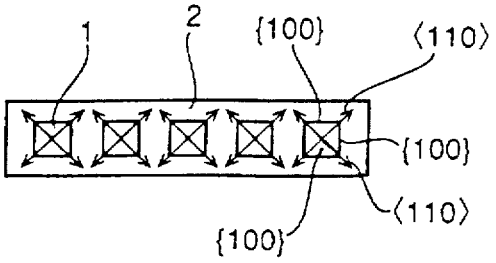
FIG. 4A PRIOR ART
FIGS. 4A to 4G illustrate working surfaces of dressers employed in the below described Examples and crystal orientations of diamond tips embedded therein, with arrows showing maximum wear-resistant directions on end surfaces of the diamond tips.
Figure 4B:
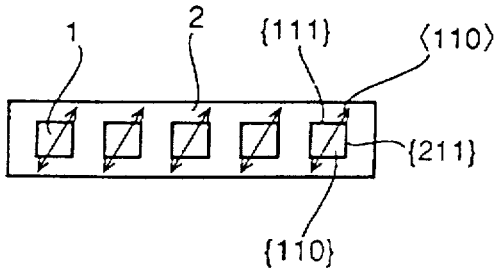
FIG. 4B PRIOR ART
Figure 4C:
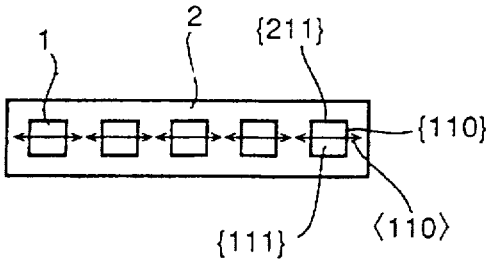
Figure 4D:
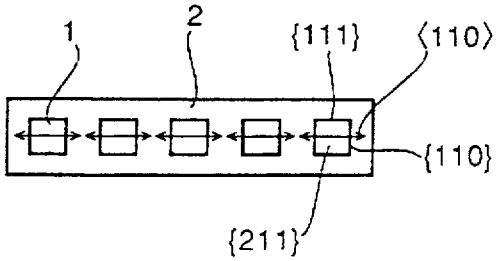
Figure 4E:
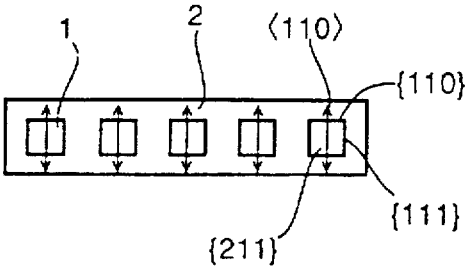
Figure 4F:
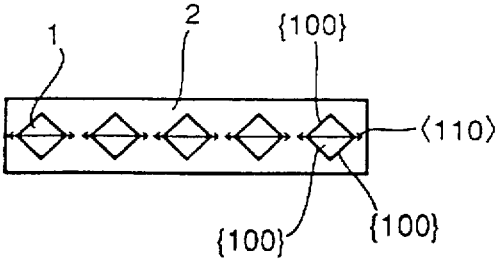
FIG. 4F PRIOR ART
Figure 4G:
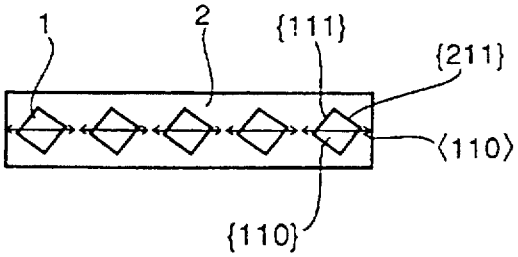
FIG. 4G PRIOR ART

Square prismatic artificial single-crystalline diamond tips of 4.0 mm in longitudinal length having square sectional shapes of 0.8 by 0.8 mm were prepared from: inventive samples having end surfaces of {211} plane orientations and side surfaces of {111} and {110} plane orientations as shown in FIGS. 4D and 4E; conventional samples having end surfaces of {110} plane orientations and side surfaces of {111} and {211} plane orientations as shown in FIGS. 4B and 4G; conventional samples having end surfaces of {100} plane orientations and side surfaces of {100} plane orientations as shown in FIGS. 4A and 4F; and a sample having a working end surface of a {111} plane orientation having the maximum wear resistance and side surfaces of {110} and {211} plane orientations as shown in FIG. 4C were also prepared. Dressers each having five such single-crystalline diamond tips were manufactured and subjected to dressing tests.

The aforementioned blade dressers were applied to dress grindstone surfaces, being reciprocated in a direction parallel with rotation axes of the grindstones at a constant speed for 10 minutes under the following wet conditions:

grindstone rotational speed: 1500 rpm grindstone: SN80N8V51S depth of cut: 0.1 mm/pass feed rate: 0.5 mm/rev.

Amounts of abrasion loss were measured after the dressing test period. Embedding accuracy of each dresser was evaluated by determining an average value of displacement of the five diamond tips from a set desired angle.

EXAMPLE 1

The aforementioned diamond tips were arranged substantially in parallel with respective sides of the tip holder as shown in FIGS. 4A, 4B, 4C, 4D and 4E for dressing grindstone surfaces along the horizontal directions in the figures, and amounts of abrasion loss were compared with each other. Further, working times required for embedding the respective tips and the plane orientation accuracy after embedding were also compared with each other. Table 1 shows the results. The forward end surface of the sample (3), having the working end surface of the {111} plane orientation, was cloven/separated in an initial stage of dressing, and it was impossible to continue the operation with sample (3). As to the samples (1), (2), (4) and (5), each was capable of continuously and stably dressing grindstone surfaces. The embedding times and embedding accuracy of these samples were hardly different from each other. In particular, every sample exhibited embedding accuracy of within 1.2 degrees, and it is conceivable that the results of the tests correctly reflect wear properties of the plane orientations. It has been verified that the inventive samples (4) and (5) have extremely smaller amounts of abrasion loss and superior wear resistance as compared with the conventional samples.

TABLE 1

| | Sample No. | Plane Orientation | Dressing Direction | Abrasion Loss ($10^{-3}$ $mm^3$) | Embedding Time (min.) | Embedding Accuracy (deg.) | Tip Arrangement |
|---|---|---|---|---|---|---|---|
| Comparative | (1) | {100} | <100> | 77.0 | 3.0 | 1.2 | FIG. 4A |
| Sample | (2) | {110} | <211> | 31.2 | 3.0 | 0.9 | FIG. 4B |
| | (3) | {111} | <110> | x | 3.0 | 1.1 | FIG. 4C |
| Inventive | (4) | {211} | <110> | 7.0 | 3.0 | 0.95 | FIG. 4D |
| Sample | (5) | {211} | <111> | 9.0 | 3.0 | 1.1 | FIG. 4E |

EXAMPLE 2

In a similar fashion and using similar tips as in Example 1, maximum wear-resistant directions of respective surfaces were arranged in the same directions as dressing directions, as shown in FIGS. 4F, 4G, 4C and 4D, in preparation for dressing grindstone surfaces. Amounts of abrasion loss, embedding times and embedding accuracy were compared with each other. In a sample (8), chipping was caused by cleavage in an initial stage of dressing similarly to the sample (3) in Example 1. It was thus impossible to continuously execute the test with sample (8). Samples (6) and (7) required long embedding times because the maximum wear-resistant directions of the diamond tips had constant inclinations with respect to ridge lines of the tips, i.e. the maximum wear-resistant direction was not parallel with any side surface of the tip and it was difficult to establish the embedding accuracy. In inventive sample (9), on the other hand, it was possible to extremely reduce the working or embedding time as compared with the conventional samples since the maximum wear-resistant direction was parallel to ridge lines and it was possible to readily position the maximum wear-resistant direction in the same direction as a working direction, while the embedding accuracy was excellent. As to samples (6) and (7), wear resistance was remarkably improved over samples (1) and (2), because it was possible to match the wear-resistant directions substantially with the working directions, as was not the case with Example 1, however, the amounts of abrasion loss thereof in samples (6) and (7) were in excess of twice as compared with the inventive sample (9). Thus, it has been clarified that wear resistance of the inventive sample is extremely high as compared with the conventional samples.

TABLE 2

| | Sample No. | Plane Orientation | Dressing Direction | Abrasion Loss ($10^{-3}$ $mm^3$) | Embedding Time (min.) | Embedding Accuracy (deg.) | Tip Arrangement |
|---|---|---|---|---|---|---|---|
| Comparative | (6) | {100} | <110> | 27.6 | 11.0 | 3.5 | FIG. 4F |
| Sample | (7) | {110} | <110> | 14.8 | 10.5 | 5.9 | FIG. 4G |
| | (8) | {111} | <110> | x | 3.5 | 1.1 | FIG. 4C |
| Inventive | (9) | {211} | <110> | 7.0 | 3.0 | 0.95 | FIG. 4D |

Although the present invention has been described and illustrated in detail, it is clearly understood that the specific embodiments are by way of illustration and example only and are not to be taken as limiting in any way, the spirit and scope of the present invention being limited only by the terms of the appended claims.

What is claimed is:

1. A single-crystalline diamond tip for a dresser comprising a single-crystalline diamond having a bar shape with a longitudinal direction, an end surface extending perpendicular to said longitudinal direction, and side surfaces extending along said longitudinal direction, wherein said end surface includes a {211} crystal plane, and a first opposite pair of said side surfaces include {111} crystal planes.

2. The single-crystalline diamond tip for a dresser in accordance with claim 1, wherein said single-crystalline diamond is artificially synthesized diamond containing nitrogen in a concentration of at least 5 ppm and not more than 300 ppm.

3. The single-crystalline diamond tip for a dresser in accordance with claim 1, wherein a second opposite pair of said side surfaces include {110} crystal planes.

4. A diamond dresser comprising:

at least one single-crystalline diamond tip, each comprising a single-crystalline diamond having a bar shape with a longitudinal direction, an end surface extending perpendicularly to said longitudinal direction, and side surfaces extending along said longitudinal direction; and a holder having said at least one single-crystalline diamond tips so embedded in said holder that said end surface of each said single-crystalline diamond tip defines a working surface for dressing a workpiece; wherein said end surface of each said single-crystalline diamond tip includes a {211} crystal plane and has a polygon shape, and a first opposite pair of said side surfaces of each said single-crystalline diamond tip include {111} crystal planes, and each said single-crystalline diamond tip is so arranged in said holder that two opposite sides of said polygon shape of said end surface of each said single-crystalline diamond tip are substantially parallel to a direction of said holder adapted to be parallel to a frictional direction of said workpiece relative to said dresser.

5. The diamond dresser in accordance with claim 4, wherein each said single-crystalline diamond is artificially synthesized diamond containing nitrogen in a concentration of at least 5 ppm and not more than 300 ppm.

6. The diamond dresser in accordance with claim 4, wherein a second opposite pair of said side surfaces include {110} crystal planes.

7. The diamond dresser in accordance with claim 4, wherein each said single-crystalline diamond tip is so arranged in said holder that said first opposite pair of said side surfaces intersect with said end surface along said two opposite sides of said polygon shape and are substantially parallel to a direction of said holder adapted to be parallel to said frictional direction of said workpiece.

* * * * *

UNITED STATES PATENT AND TRADEMARK OFFICE

CERTIFICATE OF CORRECTION

PATENT NO. : 5,785,039

DATED : July 28, 1998

INVENTOR(S) : Kobayashi et al.

It is certified that error appears in the above-identified patent and that said Letters Patent is hereby corrected as shown below:

Col. 2, line 9, after "or" insert --multi-stone--;
line 58, after "direction" insert --,--.

Col. 4, line 4, after "cleavage" insert --,--.

Signed and Sealed this

Thirteenth Day of October 1998

*Attest:*

*Attesting Officer*

Bruce Lehman

BRUCE LEHMAN

*Commissioner of Patents and Trademarks*